US011244582B2

(12) United States Patent
Wang et al.

(10) Patent No.: US 11,244,582 B2
(45) Date of Patent: Feb. 8, 2022

(54) FLEXIBLE DISPLAY DEVICE AND METHOD FOR CHANGING SHAPE OF THE SAME

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventors: Yangpeng Wang, Beijing (CN); Song Wang, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 910 days.

(21) Appl. No.: 16/062,140

(22) PCT Filed: Nov. 23, 2017

(86) PCT No.: PCT/CN2017/112538

§ 371 (c)(1),
(2) Date: Jun. 14, 2018

(87) PCT Pub. No.: WO2018/201704

PCT Pub. Date: Nov. 8, 2018

(65) Prior Publication Data

US 2021/0201708 A1 Jul. 1, 2021

(30) Foreign Application Priority Data

May 4, 2017 (CN) ..... 201710308392.1

(51) Int. Cl.
*G09F 9/00* (2006.01)
*G09F 9/30* (2006.01)

(52) U.S. Cl.
CPC ..... *G09F 9/301* (2013.01)

(58) Field of Classification Search
CPC ..... G09F 9/301
See application file for complete search history.

(56) References Cited

U.S. PATENT DOCUMENTS 7,973,744 B2 7/2011 Ishibashi et al.
9,843,758 B2 12/2017 Park et al.
(Continued)

FOREIGN PATENT DOCUMENTS

CN 103177656 A 6/2013
CN 103366641 A 10/2013
(Continued)

OTHER PUBLICATIONS

CN 105590555 A1 English Translation (Year: 2016).*
(Continued)

*Primary Examiner* — Pete T Lee
(74) *Attorney, Agent, or Firm* — Nath, Goldberg & Meyer; Joshua B. Goldberg

(57) ABSTRACT

A flexible display device and a method for changing shape of the flexible display device are provided. The flexible display device includes a flexible display panel and a shape memory structure on the flexible display panel and including a shape memory component. The shape memory component includes a first memory layer, a first thermal insulation layer and a second memory layer stacked sequentially in a direction away from the flexible display panel, the first and second memory layers each have shape memory function, the first memory layer has a first memory shape and the second memory layer has a second memory shape different from the first memory shape. The shape memory structure is configured to switch shape of the shape memory component between the first and second memory shapes by controlling
(Continued)

temperatures of the first and second memory layers, thereby driving the flexible display panel to change shape.

18 Claims, 2 Drawing Sheets

(56) References Cited

U.S. PATENT DOCUMENTS

| | | | | |
|---|---|---|---|---|
| 9,877,379 | B2 | 1/2018 | Hwang et al. | |
| 2013/0258565 | A1 | 10/2013 | Nishi | |
| 2015/0083341 | A1* | 3/2015 | Everaerts | B32B 43/006 156/711 |
| 2016/0066445 | A1* | 3/2016 | Park | G02F 1/133305 361/749 |
| 2016/0111678 | A1* | 4/2016 | Lee | C09J 7/10 257/40 |
| 2016/0202476 | A1* | 7/2016 | Chong | G02B 27/0068 359/743 |
| 2019/0006633 | A1* | 1/2019 | Wang | H01L 27/1266 |
| 2020/0028117 | A1* | 1/2020 | Eckert | B32B 27/325 |
| 2020/0150789 | A1* | 5/2020 | Woody, V | B66C 23/18 |

FOREIGN PATENT DOCUMENTS

| | | | |
|---|---|---|---|
| CN | 204229775 | U | 3/2015 |
| CN | 104756176 | A | 7/2015 |
| CN | 104766543 | A | 7/2015 |
| CN | 105190732 | A | 12/2015 |
| CN | 105432157 | A | 3/2016 |
| CN | 105590555 | A | 5/2016 |
| CN | 106910431 | A | 6/2017 |
| DE | 102008032002 | A1 | 3/2010 |
| JP | 11109880 | A | 4/1999 |
| KR | 20140003132 | A | 1/2014 |

OTHER PUBLICATIONS

The Second Office Action dated Mar. 15, 2019 corresponding to Chinese application No. 201710308392.1.

First office action of corresponding CN 201710308392.1 dated Oct. 17, 2018 and English Translation.

International search report for PCT CN2017-112538 dated Feb. 11, 2018, and English Translation.

* cited by examiner

FLEXIBLE DISPLAY DEVICE AND METHOD FOR CHANGING SHAPE OF THE SAME

CROSS-REFERENCE TO RELATED APPLICATIONS

The present application claims priority to Chinese Patent Application No. 2017103083921, filed on May 4, 2017, the contents of which are incorporated herein by reference in the entirety.

TECHNICAL FIELD

The present disclosure belongs to the field of display technology, and particularly relates to a flexible display device and a method for changing the shape of the flexible display device.

BACKGROUND

Flexible organic light-emitting diode (OLED) display devices (e.g., display screens) are bendable and foldable, and can display images normally without breakage after being bended, so they have gained popularity in the current market. In addition, even when the display devices are flat in use, these display devices still can be folded or curved for storage.

SUMMARY

In an aspect, the present disclosure provides a flexible display device, which includes a flexible display panel and a shape memory structure on the flexible display panel. The shape memory structure includes a shape memory component including a first memory layer, a first thermal insulation layer and a second memory layer stacked sequentially in a direction away from the flexible display panel, the first memory layer and the second memory layer each have a shape memory function, the first memory layer has a first memory shape, and the second memory layer has a second memory shape that is different from the first memory shape.

In some embodiments, each of the first memory layer and the second memory layer includes a material having an one-way shape memory effect. The shape memory structure is configured such that a shape of the shape memory component is changed to the first memory shape by controlling a temperature of the first memory layer above a deformation temperature of the first memory layer and controlling a temperature of the second memory layer below a deformation temperature of the second memory layer, and such that the shape of the shape memory component is changed to the second memory shape by controlling the temperature of the second memory layer above the deformation temperature of the second memory layer and controlling the temperature of the first memory layer below the deformation temperature of the first memory layer.

In some embodiments, each of the first memory layer and the second memory layer includes an electro-active shape memory material, and the first thermal insulation layer includes an electrically and thermally insulating material. The shape memory structure is configured such that the temperatures of the first memory layer and the second memory layer are controlled by controlling currents flowing through the first memory layer and the second memory layer, respectively.

In some embodiments, the shape memory structure further includes a first temperature control circuit and a second temperature control circuit configured to control the temperature of the first memory layer and the temperature of the second memory layer, respectively, by controlling the current flowing through the first memory layer and the current flowing through the second memory layer, respectively. The first temperature control circuit includes a first transmission sub-circuit for transmitting power to the first memory layer, and a first control sub-circuit for controlling characteristics of elements in the first transmission sub-circuit to control the current flowing through the first memory layer. The second temperature control circuit includes a second transmission sub-circuit for transmitting power to the second memory layer, and a second control sub-circuit for controlling characteristics of elements in the second transmission sub-circuit to control the current flowing through the second memory layer.

In some embodiments, the first transmission sub-circuit includes a first variable resistor and a first switch connected in series with the first memory layer, and the second transmission sub-circuit includes a second variable resistor and a second switch connected in series with the second memory layer.

In some embodiments, the first control sub-circuit is configured to control the resistance of the first variable resistor and the turn-on and turn-off of the first switch, and the second control sub-circuit is configured to control the resistance of the second variable resistor and the turn-on and turn-off of the second switch.

In some embodiments, the shape memory structure is configured such that the first memory layer is heated to a temperature above the deformation temperature of the first memory layer by controlling, by the first temperature control circuit, the first memory layer to have a first current flowing therethrough, and meanwhile the temperature of the second memory layer is controlled below the deformation temperature of the second memory layer by controlling, by the second temperature control circuit, the second memory layer to have no current flowing therethrough; and such that the second memory layer is heated to a temperature above the deformation temperature of the second memory layer by controlling, by the second temperature control circuit, the second memory layer to have a second current flowing therethrough, and meanwhile the temperature of the first memory layer is controlled below the deformation temperature of the first memory layer by controlling, by the first temperature control circuit, the first memory layer to have no current flowing therethrough.

In some embodiments, the shape memory structure is configured such that the first memory layer is heated by controlling, by the first temperature control circuit, a magnitude of the first current flowing through the first memory layer and the second memory layer is heated by controlling, by the second temperature control circuit, a magnitude of the second current flowing through the second memory layer, to control the temperature of the first memory layer and the temperature of the second memory layer. The first current and the second current are non-zero currents.

In some embodiments, the shape memory structure further includes a second thermal insulation layer between the first memory layer and the flexible display panel.

In some embodiments, the flexible display panel has a display surface and a back surface opposite to the display surface, and the shape memory structure is on the back surface of the flexible display panel.

In some embodiments, the shape memory structure includes a single shape memory component covering an entire area of the flexible display panel.

In some embodiments, the shape memory structure includes a plurality of shape memory components in different areas of the flexible display panel, respectively.

In some embodiments, the shape memory structure includes a plurality of pairs of the first temperature control circuit and the second temperature control circuit, and each pair of the first temperature control circuit and the second temperature control circuit corresponds to one of the plurality of shape memory components such that the plurality of shape memory components are controlled independently.

In another aspect, the present disclosure provides a method for changing a shape of a flexible display device. The flexible display device includes a flexible display panel and a shape memory structure having a shape memory component, the shape memory component includes a first memory layer, a first thermal insulation layer and a second memory layer stacked sequentially in a direction away from the flexible display panel, the first memory layer and the second memory layer each have a shape memory function, the first memory layer has a first memory shape, and the second memory layer has a second memory shape that is different from the first memory shape. The method includes:

controlling a temperature of the first memory layer above a deformation temperature of the first memory layer and controlling a temperature of the second memory layer below a deformation temperature of the second memory layer to change a shape of the shape memory component to the first memory shape, thereby driving the flexible display panel to change its shape; and controlling the temperature of the second memory layer above the deformation temperature of the second memory layer and controlling the temperature of the first memory layer below the deformation temperature of the first memory layer to change the shape of the shape memory component to the second memory shape, thereby driving the flexible display panel to change its shape.

In some embodiments, in a case of changing the shape of the shape memory component to the first memory shape, the temperature of the second memory layer is controlled below the deformation temperature of the second memory layer; and in a case of changing the shape of the shape memory component to the second memory shape, the temperature of the first memory layer is controlled below the deformation temperature of the first memory layer.

In some embodiments, each of the first memory layer and the second memory layer includes an electro-active shape memory material having an one-way shape memory effect, the first thermal insulation layer includes an electrically and thermally insulating material, and the temperatures of the first memory layer and the second memory layer are controlled by controlling currents flowing through the first memory layer and the second memory layer, respectively.

In some embodiments, the shape memory structure further includes a first variable resistor and a first switch connected in series with the first memory layer and configured to transmit power to the first memory layer, and a second variable resistor and a second switch connected in series with the second memory layer and configured to transmit power to the second memory layer. In the step of controlling the temperatures of the first memory layer and the second memory layer, the current flowing through the first memory layer is controlled by controlling the resistance of the first variable resistor and the turn-on and turn-off of the first switch, and the current flowing through the second memory layer is controlled by controlling the resistance of the second variable resistor and the turn-on and turn-off of the second switch.

In some embodiments, the first memory layer is heated to a temperature above the deformation temperature of the first memory layer by controlling the first memory layer to have a first current flowing therethrough, and the temperature of the second memory layer is controlled below the deformation temperature of the second memory layer by controlling the second memory layer to have no current flowing therethrough. The second memory layer is heated to a temperature above the deformation temperature of the second memory layer by controlling the first memory layer to have no current flowing therethrough and the temperature of the first memory layer is controlled below the deformation temperature of the first memory layer by controlling the second memory layer to have a second current flowing therethrough.

In some embodiments, the temperatures of the first memory layer and the second memory layer are controlled by controlling a magnitude of the first current flowing through the first memory layer to heat the first memory layer and controlling a magnitude of the second current flowing through the second memory layer to heat the second memory layer. The first current and the second current are non-zero currents.

In another aspect, the present disclosure provides a method for fabricating a flexible display device. The method includes: preparing a flexible display panel; and forming, on the flexible display panel, a shape memory structure including a shape memory component, the shape memory component including a first memory layer, a first thermal insulation layer, and a second memory layer stacked sequentially in a direction away from the flexible display panel. During the formation of the shape memory structure, the temperatures of the first memory layer and the second memory layer are controlled above deformation temperatures of the first memory layer and the second memory layer, respectively, and an external force is applied to the first memory layer and the second memory layer so that the shapes of the first memory layer and the second memory layer conform to a predetermined initial shape of the flexible display device; then, the temperatures of the first memory layer and the second memory layer are controlled below the deformation temperature of the first memory layer and the second memory layer, respectively, while maintaining the external force, so that the shapes of the first memory layer and the second memory layer are maintained to conform to the predetermined initial shape of the flexible display device.

DETAILED DESCRIPTION

Figure 1:
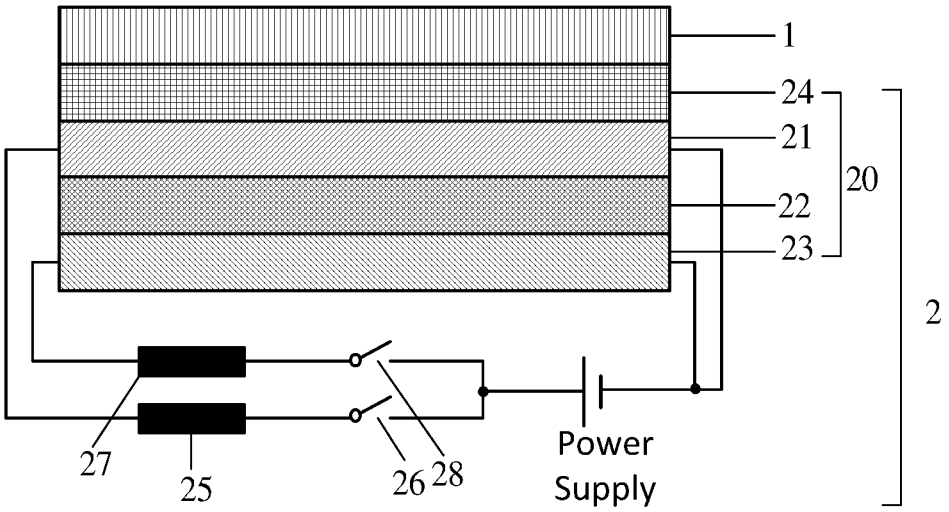
FIG. 1 is a schematic diagram illustrating a structure of a flexible display device according to an embodiment of the present disclosure.

To make those skilled in the art better understand the technical solutions of the present disclosure, the present disclosure will be further described in detail below in conjunction with the accompanying drawings and embodiments.

In the conventional flexible display device, the shape of the flexible display device is changeable, but cannot recover a specific shape (e.g., having an optimal degree of bending) by itself.

Accordingly, the present disclosure provides, inter alia, a flexible display device and a method for changing a shape of a flexible display device that substantially obviate one or more of the problems due to limitations and disadvantages of the related art.

Herein, the term "shape memory material" refers to a material having a permanent shape (also referred to as "memory shape") and a temporary shape (also referred to as "deformation shape"). For a shape memory material, it initially has the permanent shape. When the shape memory material is heated to a temperature above its deformation temperature while undergoing an external stress, the shape memory material is deformed into a temporary shape depending on the external stress. In this case, the shape memory material maintains this temporary shape by cooling it to a temperature below its deformation temperature while maintaining the external stress. When the shape memory material is heated to a temperature above its deformation temperature without undergoing any external stress, the shape memory material can recover the permanent shape, for example, from any other shape to the permanent shape. Here, the term "deformation temperature" refers to a temperature at which the microstructure (such as a molecular network) of a shape memory material changes to thus change its macroscopic shape. The deformation temperature is an inherent property of a shape memory material, and may represent a glass transition temperature, a melting temperature, or the like depending on the kind of the material.

As illustrated in FIGS. 1 to 5, the present disclosure provides a flexible display device capable of recovering a predetermined shape after being deformed.

The flexible display device includes a flexible display panel 1 and a shape memory structure 2. The shape memory structure 2 is on part or the entirety of the flexible display panel 1. The shape memory function of the shape memory structure 2 can drive part or the entirety of the flexible display panel 1 to be deformed into a predetermined shape. The predetermined shape may include a first memory shape and a second memory shape of the shape memory structure 2.

In some embodiments, the flexible display panel 1 is a flexible OLED display panel. The shape memory structure 2 may include a shape memory material having a shape memory function.

Specifically, the shape memory structure 2 includes a shape memory component 20, which includes a first memory layer 21, a first thermal insulation layer 22, and a second memory layer 23 stacked sequentially in a direction away from the flexible display panel 1.

In some embodiments, the orthographic projection of the first memory layer 21 over the flexible display panel 1 overlaps with that of the second memory layer 23. The first memory layer 21 is closer to the flexible display panel 1 than the second memory layer 23, and the first and second memory layers 21 and 23 have a same shape and are disposed on the flexible display panel 1 correspondingly. The first and second memory layers 21 and 23 may be disposed on the flexible display panel 1 in a manner of adhering, etc., which is not specifically limited herein.

The first memory layer 21 and the second memory layer 23 are made of a shape memory material, which may be a thermally-induced shape memory material or an electroactive shape memory material. In some embodiments, the first memory layer 21 and the second memory layer 23 are made of an electro-active shape memory material. As an example, the electro-active shape memory material may include a polyurethane elastomer, a composite of crystalline polyoxyethylene/carbon nanotubes, a composite of polylactic acid/ethylene vinyl acetate/carbon nanotubes, and the like. It can be understood that the materials of the first memory layer 21 and the second memory layer 23 may be the same or different from each other, and are not specifically limited herein.

The first memory layer 21 has a first memory shape, and the second memory layer 23 has a second memory shape. By controlling the temperature of the first memory layer 21 above its deformation temperature and controlling the temperature of the second memory layer 23 below its deformation temperature to restore the shape of the first memory layer 21 to the first memory shape, or by controlling the temperature of the second memory layer 23 above its deformation temperature and controlling the temperature of the first memory layer 21 below its deformation temperature to restore the shape of the first memory layer 21 to the second memory shape, both of the entire shape memory component 20 and the flexible display panel 1 can be driven to deform. The first memory shape is different from the second memory shape. Therefore, the flexible display device can recover the first memory shape or the second memory shape from arbitrary shape, and thus has a two-way reversible shape memory function.

In some embodiments, the first memory layer 21 and the second memory layer 23 may include a material having an one-way shape memory effect (e.g., a shape memory polymer (SMP) having an one-way shape memory effect). Generally, a one-way shape memory material initially has one permanent shape (i.e., memory shape). Therefore, when the one-way shape memory material is heated to a temperature above its deformation temperature without being applied with any external stress, the one-way shape memory material can only recover the one memory shape from other shapes.

In the embodiments of the present disclosure, by combining the first memory layer 21 and the second memory layer 23 with different memory shapes and controlling the temperatures of the two memory layers, a two-way shape memory function can be realized by using one-way shape memory materials.

Since the shape memory function of the shape memory material is relevant to the temperature, a first thermal insulation layer 22 is disposed between the first memory layer 21 and the second memory layer 23 to isolate heat transfer between the first memory layer 21 and the second memory layer 23, thereby preventing the temperature of one of the memory layers from affecting the other. In a case where the shape memory material is an electro-active shape memory material, the first thermal insulation layer 22 is made of an electrically insulating material in order to prevent the currents in the two memory layers from affecting each other. As an example, the electrically and thermally insulating material may include expanded polystyrene, urethane foam, and the like. It can be understood that the electrically and thermally insulating material is not limited thereto, as long as it can electrically and thermally isolate the first memory layer from the second memory layer.

The shape memory structure 2 may include a first temperature control circuit and a second temperature control circuit. The first temperature control circuit is configured to control the temperature of the first memory layer 21, and the second temperature control circuit is configured to control the temperature of the second memory layer 23.

Since the shape memory material can recover the predetermined shape only if it is under a certain temperature condition, the temperatures of the first memory layer 21 and the second memory layer 23 are controlled by the first temperature control circuit and the second temperature control circuit, respectively, so as to control the shape memory structure 2 to recover the predetermined shape.

In some embodiments, when the first memory layer 21 and the second memory layer 23 are formed of an electro-active shape memory material, the temperatures of the first memory layer and the second memory layer are controlled by controlling currents flowing through the first memory layer and the second memory layer respectively.

In this case, the first temperature control circuit includes a first transmission sub-circuit for transmitting power to the first memory layer 21, and a first control sub-circuit for controlling characteristics of elements in the first transmission sub-circuit to control the current flowing through the first memory layer 21. The second temperature control circuit includes a second transmission sub-circuit for transmitting power to the second memory layer 23, and a second control sub-circuit for controlling characteristics of elements in the second transmission sub-circuit to control the current flowing through the second memory layer 23.

The currents flowing through the first memory layer 21 and the second memory layer 23 are controlled by the first transmission sub-circuit and the first control sub-circuit, and the second transmission sub-circuit and the second control sub-circuit, respectively, so that the temperatures of the first and second memory layers 21 and 23 are controlled.

In some embodiments, the first transmission sub-circuit includes a first variable resistor 25 and a first switch 26 connected in series with the first memory layer 21, and the second transmission sub-circuit includes a second variable resistor 27 and a second switch 28 connected in series with the second memory layer 23. The first control sub-circuit is configured to control the resistance value of the first variable resistor and the turn-on and turn-off of the first switch, and the second control sub-circuit is configured to control the resistance value of the second variable resistor and the turn-on and turn-off of the second switch.

FIG. 1 illustrates a case where the shape memory structure 2 includes a power supply and the first and second transmission sub-circuits transmit power from the power supply. It can be understood that the shape memory structure 2 may not include a power supply, and the first and second transmission sub-circuits may transmit external power to the first and second memory layers.

As illustrated in FIG. 1, the first variable resistor 25 and the first switch 26 are connected in series with the first memory layer 21. The first switch 26 controls the conduction state of the first transmission sub-circuit (i.e., whether current flows through the first memory layer 21), and the magnitude of the current flowing through the first memory layer 21 may be changed by adjusting the resistance of the first variable resistor 25.

It can be understood that in the first transmission sub-circuit, the smaller the resistance value of the first variable resistor 25, the larger the current flowing through the first memory layer 21, and the higher the temperature of the first memory layer 21.

Similarly, the temperature of the second memory layer 23 may be controlled by the second variable resistor 27 and the second switch 28.

The flexible display panel 1 will generate certain heat during operation, and the shape memory function of the shape memory structure 2 is related to temperature. Thus, in order to avoid the adverse effect of the flexible display panel 1 on the shape memory structure 2, a thermal insulation layer may be provided, that is, a second thermal insulation layer 24 may be disposed between the first memory layer 21 and the flexible display panel 1, to isolate heat transfer between the flexible display panel 1 and the shape memory structure 2. In a case where the shape memory material is an electro-active shape memory material, the second thermal insulation layer is made of an electrically and thermally insulating material.

In some embodiments, the flexible display panel 1 has a display surface and a back surface opposite to the display surface, and the shape memory structure 2 is on the back surface of the flexible display panel 1.

Generally, the flexible display panel 1 has the display surface and the back surface, and the shape memory structure 2 may be disposed on the back surface of the flexible display panel 1 so as not to adversely affect the display effect of the flexible display device.

In some embodiments, the shape memory component 20 is provided in an entire area of the flexible display panel 1.

Figure 2:
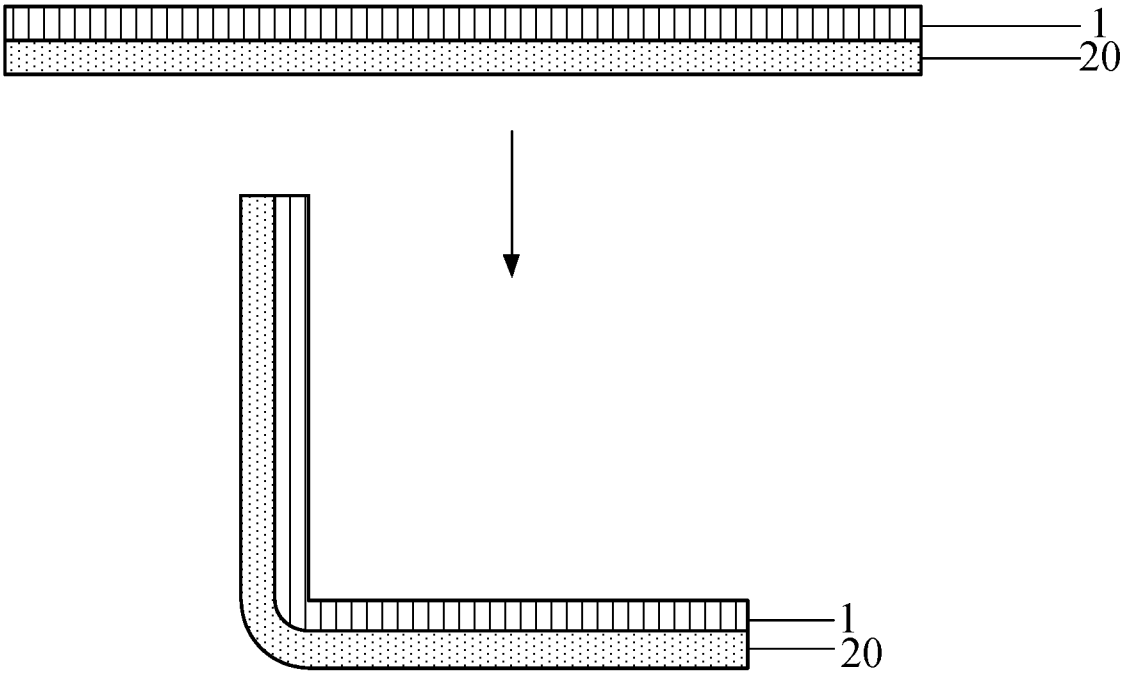
FIG. 2 is a schematic diagram illustrating a structure of a flexible display device switching between different states, according to an embodiment of the present disclosure.
Figure 3:
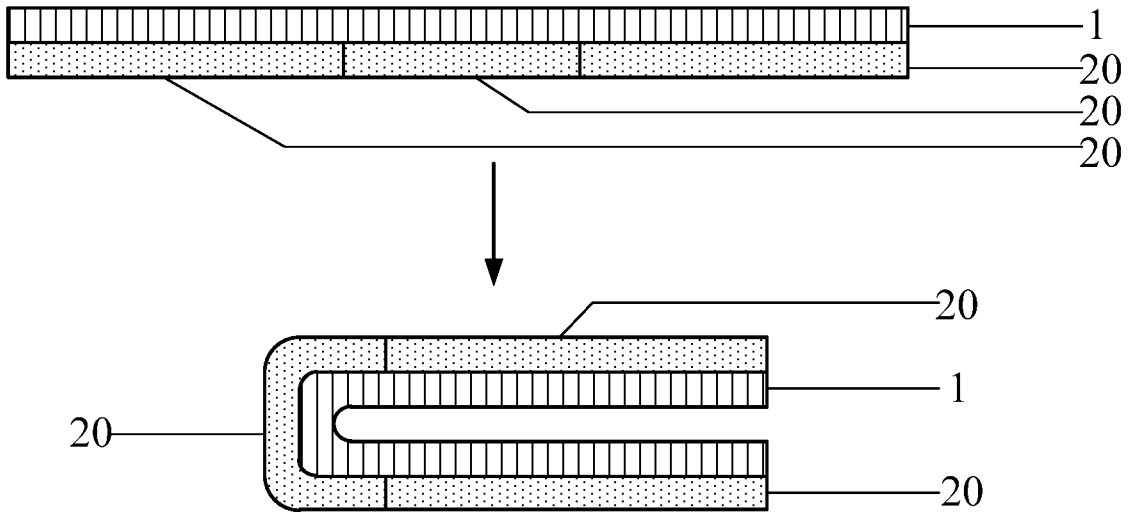
FIG. 3 is a schematic diagram illustrating a structure of another flexible display device switching between different states, according to an embodiment of the present disclosure.

It can be understood that, as illustrated in FIGS. 2 and 3, the shape memory component 20 being provided in the entire area of the flexible display panel 1 may be implemented in two ways. One is to cover the entire area of the flexible display panel 1 with a single shape memory component 20, such that the shape memory structure 2 drives the entirety of the flexible display panel 1 to deform. The other is to cover the entire area of the flexible display panel 1 with a plurality of shape memory components 20, which can realize not only the deformation of the entirety of the flexible display panel 1 but also the deformation of part of the flexible display panel 1.

Figure 4:
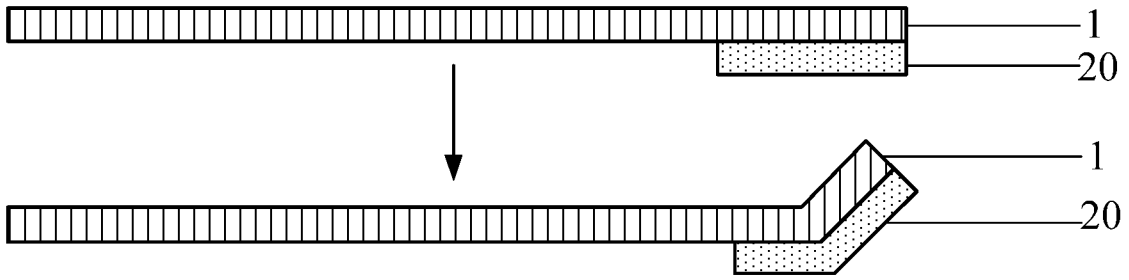
FIG. 4 is a schematic diagram illustrating a structure of another flexible display device switching between different states, according to an embodiment of the present disclosure.

Needless to say, alternatively, the shape memory component 20 may provided in only a partial area of the flexible display panel 1 to drive only part of the flexible display panel 1 to deform, as illustrated in FIG. 4.

Figure 5:
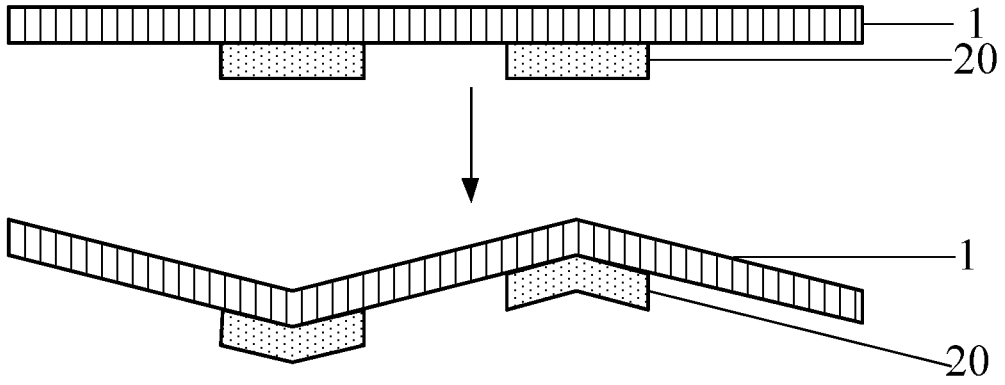
FIG. 5 is a schematic diagram illustrating a structure of another flexible display device switching between different states, according to an embodiment of the present disclosure.

In some embodiments, as illustrated in FIG. 5, the shape memory structure 2 may include a plurality of shape memory components 20 disposed in a plurality of areas of the flexible display panel 1, respectively.

In some embodiments, the plurality of shape memory components 20 may be controlled independently. For example, as illustrated in FIG. 3, only some of the shape memory components 20 recover the shape at the same time. In this case, the shape memory structure 2 includes a plurality of pairs of the first temperature control circuit and the second temperature control circuit, and each pair of the first temperature control circuit and the second temperature control circuit corresponds to one of the plurality of shape memory components 20 such that the plurality of shape memory components 20 are controlled independently.

By having the plurality of shape memory components 20 drive different areas of the flexible display panel 1 to deform, respectively, the flexible display device thus has a variety of memory shapes.

It can be understood that there are many other ways of arranging the shape memory components 20 on the flexible display panel 1, for example, the shape memory components 20 may be arranged along the axis of symmetry of the flexible display panel 1, which will not be described in detail herein.

It can be understood that the first temperature control circuit and the second temperature control circuit may be disposed on the flexible display panel 1 and integrated with the shape memory component 20, or may be separately provided.

The flexible display device according to the present disclosure includes the flexible display panel and the shape memory structure having the shape memory component. By having the temperature of the first memory layer or the second memory layer in the shape memory component reach the deformation temperature, the shape of the shape memory component is restored to the first memory shape or the second memory shape, thereby driving a corresponding area of the flexible display panel to deform, so that the flexible display device has a two-way shape memory function.

As illustrated in FIGS. 1 to 5, the present disclosure provides a method for changing a shape of a flexible display device, which can be applied to the above flexible display device to make the flexible display device recover a predetermined shape after deformation.

The method includes: when a shape of an area of the flexible display panel 1 in which the shape memory component 20 is provided is to be changed to the first memory shape, heating the first memory layer 21 by the first temperature control circuit to make the temperature of the first memory layer 21 above its deformation temperature, and controlling the temperature of the second memory layer 23 below its deformation temperature, to change the shape of the corresponding area of the flexible display panel 1 to the first memory shape; and when the shape of the area of the flexible display panel 1 in which the shape memory component 20 is provided is to be changed to the second memory shape, heating the second memory layer 23 by the second temperature control circuit to make the temperature of the second memory layer 23 above its deformation temperature, and controlling the temperature of the first memory layer 21 below its deformation temperature, to change the shape of the corresponding area of the flexible display panel 1 to the second memory shape.

When the temperature of the first memory layer 21 reaches its deformation temperature, the first memory layer 21 itself generates a shape recovery force for recovering the first memory shape such that the shape of the first memory layer 21 is recovered from the current shape to the first memory shape, and meanwhile, due to the connection (e.g., fixation) of the first memory layer 21 with the second memory layer 23 and the flexible display panel 1, the second memory layer 23 and the corresponding part of the flexible display panel 1 are driven to deform to the first memory shape, thereby changing the shape of the flexible display device.

It can be understood that, when the temperature of the first memory layer 21 reaches its deformation temperature and the temperature of the second memory layer 23 is below its deformation temperature, the shape recovery force of the first memory layer 21 should be greater than the shape fixing force of the second memory layer 23 and the corresponding part of the flexible display panel 1 for fixing the current shape thereof.

Specifically, when the shape of the area of the flexible display panel 1 in which the shape memory component 20 is provided is to be changed to the first memory shape, the first switch 26 is turned on and the resistance of the first variable resistor 25 is adjusted so that the current flowing through the first memory layer 21 is increased to a preset current value, and thus the temperature of the first memory layer 21 is equal to or higher than its deformation temperature. When the flexible display device has been deformed to the predetermined shape (the area of the flexible display panel 1 where the shape memory component 20 is provided has the first memory shape), the first switch 26 is turned off. The preset current value may be set according to the material of the first memory layer 21 and the practical situation, and is not limited herein.

In this case, in some embodiments, the second switch 28 may be controlled to be turned off by the second temperature control circuit so that no current flows through the second memory layer 23, thus the second memory layer 23 is not heated, which ensures that the temperature of the second memory layer 23 (for example, room temperature) is below its deformation temperature.

In some embodiments, the second memory layer 23 may also be heated to a temperature below its deformation temperature by turning on the second switch 28 and adjusting the resistance of the second variable resistor 27. By heating the second memory layer 23 to make the same soft, the second memory layer 23 is prone to be deformed by the first memory layer 21. Since the heated second memory layer 23 has a temperature below its deformation temperature, the second memory layer 23 can be prevented from recovering the second memory shape.

Similarly, when the temperature of the second memory layer 23 reaches its deformation temperature while the temperature of the first memory layer 21 is below its deformation temperature, the second memory layer 23 can drive the first memory layer 21 and the corresponding part of the flexible display panel 1 to deform to the second memory shape, thereby changing the shape of the flexible display device.

Specifically, when the shape of the area of the flexible display panel 1 in which the shape memory component 20 is provided is to be changed to the second memory shape, the second switch 28 is turned on and the resistance of the second variable resistor 27 is adjusted so that the current flowing through the second memory layer 23 is increased to a preset current value, and thus the temperature of the second memory layer 23 is equal to or higher than its deformation temperature. When the flexible display device has been deformed to the predetermined shape (the area of the flexible display panel 1 where the shape memory component 20 is provided has the second memory shape), the second switch 28 is turned off. The preset current value may be set according to the material of the second memory layer 23 and the practical situation, and is not limited herein.

In this case, in some embodiments, the first switch 26 may be controlled to be turned off by the first temperature control circuit so that no current flows through the first memory layer 21, thus the first memory layer 21 is not heated, which ensures that the temperature of the first memory layer 21 (for example, room temperature) is below its deformation temperature.

In some embodiments, the first memory layer 21 may also be heated to a temperature below its deformation temperature by turning on the first switch 26 and adjusting the resistance of the first variable resistor 25. By heating the first memory layer 21 to make the same soft, the first memory layer 21 is prone to be deformed by the second memory layer 23. Since the heated first memory layer 21 has a temperature below its deformation temperature, the first memory layer 21 can be prevented from recovering the first memory shape.

In practice, the initial shape of the flexible display device may be different from the first and second memory shapes according to user needs. Therefore, the present disclosure provides, inter alia, a method for fabricating the above flexible display device. The method includes: preparing the flexible display panel 1; and forming the shape memory structure 2 including the shape memory component 20 on the flexible display panel 1. The shape memory component 20 includes a first memory layer, a first thermal insulation layer, and a second memory layer stacked sequentially in a direction away from the flexible display panel. During the formation of the shape memory structure 2, the first memory layer 21 and the second memory layer 23 are heated to temperatures above the respective deformation temperatures, and in this case, an external force is applied to the first memory layer 21 and the second memory layer 23 so that the shapes of the first memory layer 21 and the second memory layer 23 conform to a predetermined initial shape of the flexible display device; then, the first memory layer 21 and the second memory layer 23 are cooled to temperatures below the respective deformation temperature, while maintaining the external force, so that the shapes of the first memory layer 21 and the second memory layer 23 are maintained to conform to the predetermined initial shape of the flexible display device.

It can be understood that the foregoing implementations are merely exemplary implementations used for describing the principle of the present disclosure, but the present disclosure is not limited thereto. Those ordinary skilled in the art may make various variations and improvements without departing from the spirit and essence of the present disclosure, and these variations and improvements shall fall into the protection scope of the present disclosure.

What is claimed is:

1. A flexible display device, comprising:

a flexible display panel; and a shape memory structure on the flexible display panel and which comprises a shape memory component, wherein the shape memory component comprises a first memory layer, a first thermal insulation layer and a second memory layer stacked sequentially in a direction away from the flexible display panel, the first memory layer and the second memory layer each have a shape memory function, the first memory layer has a first memory shape, and the second memory layer has a second memory shape that is different from the first memory shape, wherein the shape memory structure is configured such that a shape of the shape memory component is changed to the first memory shape by controlling a temperature of the first memory layer above a deformation temperature of the first memory layer and controlling a temperature of the second memory layer below a deformation temperature of the second memory layer, and such that the shape of the shape memory component is changed to the second memory shape by controlling the temperature of the second memory layer above the deformation temperature of the second memory layer and controlling the temperature of the first memory layer below the deformation temperature of the first memory layer.

2. The flexible display device according to claim 1, wherein each of the first memory layer and the second memory layer comprises a material having an one-way shape memory effect.

3. The flexible display device according to claim 2, wherein each of the first memory layer and the second memory layer comprises an electro-active shape memory material, the first thermal insulation layer comprises an electrically and thermally insulating material, and the shape memory structure is configured such that the temperatures of the first memory layer and the second memory layer are controlled by controlling currents flowing through the first memory layer and the second memory layer, respectively.

4. The flexible display device according to claim 3, wherein the shape memory structure further comprises a first temperature control circuit and a second temperature control circuit configured to control the temperature of the first memory layer and the temperature of the second memory layer, respectively, by controlling the current flowing through the first memory layer and the current flowing through the second memory layer, respectively, the first temperature control circuit comprises a first transmission sub-circuit for transmitting power to the first memory layer, and a first control sub-circuit for controlling characteristics of elements in the first transmission sub-circuit to control the current flowing through the first memory layer, and the second temperature control circuit comprises a second transmission sub-circuit for transmitting power to the second memory layer, and a second control sub-circuit for controlling characteristics of elements in the second transmission sub-circuit to control the current flowing through the second memory layer.

5. The flexible display device according to claim 4, wherein the first transmission sub-circuit comprises a first variable resistor and a first switch connected in series with the first memory layer, the second transmission sub-circuit comprises a second variable resistor and a second switch connected in series with the second memory layer, the first control sub-circuit is configured to control resistance of the first variable resistor and turn-on and turn-off of the first switch, and the second control sub-circuit is configured to control resistance of the second variable resistor and turn-on and turn-off of the second switch.

6. The flexible display device according to claim 4, wherein the shape memory structure is configured such that the first memory layer is heated to a temperature above the deformation temperature of the first memory layer by controlling, by the first temperature control circuit, the first memory layer to have a first current flowing therethrough, and meanwhile the temperature of the second memory layer is controlled below the deformation temperature of the second memory layer by controlling, by the second temperature control circuit, the second memory layer to have no current flowing therethrough, and the second memory layer is heated to a temperature above the deformation temperature of the second memory layer by controlling, by the second temperature control circuit, the second memory layer to have a second current flowing therethrough, and meanwhile the temperature of the first memory layer is controlled below the deformation temperature of the first memory layer by controlling, by the first temperature control circuit, the first memory layer to have no current flowing therethrough.

7. The flexible display device according to claim 4, wherein the shape memory structure is configured such that the first memory layer is heated by controlling, by the first temperature control circuit, a magnitude of the first current flowing through the first memory layer and the second memory layer is heated by controlling, by the second temperature control circuit, a magnitude of the second current flowing through the second memory layer, to control the temperature of the first memory layer and the temperature of the second memory layer, the first current and the second current being non-zero currents.

8. The flexible display device according to claim 1, wherein the shape memory component further comprises a second thermal insulation layer between the first memory layer and the flexible display panel.

9. The flexible display device according to claim 1, wherein the flexible display panel has a display surface and a back surface opposite to the display surface, and the shape memory structure is on the back surface of the flexible display panel.

10. The flexible display device according to claim 1, wherein the shape memory structure comprises a single shape memory component covering an entire area of the flexible display panel.

11. The flexible display device according to claim 1, wherein the shape memory structure comprises a plurality of shape memory components in different areas of the flexible display panel, respectively.

12. The flexible display device according to claim 11, wherein the shape memory structure comprises a plurality of pairs of the first temperature control circuit and the second temperature control circuit, and each of the plurality of pairs of the first temperature control circuit and the second temperature control circuit corresponds to one of the plurality of shape memory components and is configured to control the temperature of the first memory layer of a corresponding one of the plurality of shape memory components and the temperature of the second memory layer of the corresponding one of the plurality of shape memory components, respectively, by controlling the current flowing through the first memory layer of the the corresponding one of the plurality of shape memory components and the current flowing through the second memory layer of the corresponding one of the plurality of shape memory components, respectively, such that the plurality of shape memory components are controlled independently.

13. A method for changing a shape of a flexible display device, the flexible display device comprising a flexible display panel and a shape memory structure having a shape memory component, the shape memory component comprising a first memory layer, a first thermal insulation layer and a second memory layer stacked sequentially in a direction away from the flexible display panel, the first memory layer and the second memory layer each having a shape memory function, the first memory layer having a first memory shape, and the second memory layer having a second memory shape that is different from the first memory shape, the method comprising:

controlling a temperature of the first memory layer above a deformation temperature of the first memory layer and controlling a temperature of the second memory layer below a deformation temperature of the second memory layer to change a shape of the shape memory component to the first memory shape, thereby driving the flexible display panel to change its shape; and controlling the temperature of the second memory layer above the deformation temperature of the second memory layer and controlling the temperature of the first memory layer below the deformation temperature of the first memory layer to change the shape of the shape memory component to the second memory shape, thereby driving the flexible display panel to change its shape.

14. The method according to claim 13, wherein each of the first memory layer and the second memory layer comprises an electro-active shape memory material having an one-way shape memory effect, the first thermal insulation layer comprises an electrically and thermally insulating material, and the temperatures of the first memory layer and the second memory layer are controlled by controlling currents flowing through the first memory layer and the second memory layer, respectively.

15. The method according to claim 14, wherein the shape memory structure further comprises a first variable resistor and a first switch connected in series with the first memory layer and configured to transmit power to the first memory layer, and a second variable resistor and a second switch connected in series with the second memory layer and configured to transmit power to the second memory layer, and the current flowing through the first memory layer is controlled by controlling resistance of the first variable resistor and turn-on and turn-off of the first switch, and the current flowing through the second memory layer is controlled by controlling resistance of the second variable resistor and turn-on and turn-off of the second switch.

16. The method according to claim 15, wherein the first memory layer is heated to a temperature above the deformation temperature of the first memory layer and the temperature of the second memory layer is controlled below the deformation temperature of the second memory layer by controlling, by the first temperature control circuit, the first memory layer to have a first current flowing therethrough and controlling, by the second temperature control circuit, the second memory layer to have no current flowing therethrough, and the second memory layer is heated to a temperature above the deformation temperature of the second memory layer and the temperature of the first memory layer is controlled below the deformation temperature of the first memory layer by controlling, by the first temperature control circuit, the first memory layer to have no current flowing therethrough and controlling, by the second temperature control circuit, the second memory layer to have a second current flowing therethrough.

17. The method according to claim 15, wherein the temperatures of the first memory layer and the second memory layer are controlled by controlling, by the first temperature control circuit, a magnitude of the first current flowing through the first memory layer to heat the first memory layer and controlling, by the second temperature control circuit, a magnitude of the second current flowing through the second memory layer to heat the second memory layer, the first current and the second current being non-zero currents.

18. A method for fabricating a flexible display device, comprising:

preparing a flexible display panel; and forming, on the flexible display panel, a shape memory structure comprising a shape memory component, the shape memory component comprising a first memory layer, a first thermal insulation layer, and a second memory layer stacked sequentially in a direction away from the flexible display panel, wherein during the formation of the shape memory structure, the temperatures of the first memory layer and the second memory layer are controlled above deformation temperatures of the first memory layer and the second memory layer, respectively, and an external force is applied to the first memory layer and the second memory layer so that the shapes of the first memory layer and the second memory layer conform to a predetermined initial shape of the flexible display device, and subsequentially, the temperatures of the first memory layer and the second memory layer are controlled below the deformation temperature of the first memory layer and the second memory layer, respectively, while maintaining the external force, so that the shapes of the first memory layer and the second memory layer are maintained to conform to the predetermined initial shape of the flexible display device.

* * * * *